US010207397B1

(12) United States Patent
Troutman

(10) Patent No.: US 10,207,397 B1
(45) Date of Patent: Feb. 19, 2019

(54) SLEEVER BAR

(71) Applicant: David Troutman, Springfield, WV (US)

(72) Inventor: David Troutman, Springfield, WV (US)

( * ) Notice: Subject to any disclaimer, the term of this patent is extended or adjusted under 35 U.S.C. 154(b) by 122 days.

(21) Appl. No.: 15/244,034

(22) Filed: Aug. 23, 2016

Related U.S. Application Data

(60) Provisional application No. 62/301,936, filed on Mar. 1, 2016.

(51) Int. Cl.
*B25F 1/00* (2006.01)
*B25B 27/14* (2006.01)
*B66F 15/00* (2006.01)

(52) U.S. Cl.
CPC ..... *B25B 27/14* (2013.01); *B25F 1/00* (2013.01); *B66F 15/00* (2013.01)

(58) Field of Classification Search
CPC . B25B 27/14; B25B 27/16; B25F 1/00; B66F 15/00
USPC ..... 254/131, 19, 21, 25; 269/43; 7/166
See application file for complete search history.

(56) References Cited

U.S. PATENT DOCUMENTS 1,519,786 A * 12/1924 McCormick ..... B25F 1/00 408/189
1,570,192 A * 1/1926 Younick ..... B66F 15/00 254/131
2,458,219 A * 1/1949 Staus ..... B66F 15/00 254/131
2,654,569 A * 10/1953 Cooper ..... B25B 27/16 254/100
2,938,412 A * 5/1960 Walker ..... B21D 1/06 125/40
3,029,502 A * 4/1962 Middaugh ..... B25B 27/0035 254/129
3,398,625 A * 8/1968 Ansingh ..... B21H 3/027 411/416
3,568,657 A * 3/1971 Gue ..... B25D 1/16 125/40
3,739,451 A * 6/1973 Jacobson ..... B25B 27/16 285/27
3,939,512 A * 2/1976 Thurston ..... F16B 25/0047 411/416

(Continued)

FOREIGN PATENT DOCUMENTS

WO 02055268 7/2002

OTHER PUBLICATIONS

Allem MFG Co, Automobile Trade Directory. "The Allen Safety Set Screw." 1932.*

*Primary Examiner* — Joseph J Hail
*Assistant Examiner* — Arman Milanian

(57) ABSTRACT

The improved sleever bar comprises a bar, a removable nut and a fixed nut. The fixed nut is permanently attached to the bar at a fixed position. The removable nut is attached to the bar such that the position of the removable nut is adjustable. In a first function of the improved sleever bar, the improved sleever bar aligns the first object with the second object such that the center axis of each of a first plurality of holes is aligned with the center axis of a hole selected from a second plurality of holes such that a nut and bolt selected from a plurality of nuts and bolts can be used to secure the first object to the second object. In a second function of the improved sleever bar, the improved sleever bar separates the first object from the second object.

8 Claims, 4 Drawing Sheets

(56) References Cited

U.S. PATENT DOCUMENTS 4,027,373 A * 6/1977 Kwast ..... F16L 23/006 29/238
4,052,045 A * 10/1977 Shaddix ..... F16L 23/003 269/43
4,671,324 A * 6/1987 Neill ..... B25B 27/16 138/44
4,675,994 A * 6/1987 Detloff ..... B25B 9/02 29/270
5,004,017 A 4/1991 White
5,513,547 A * 5/1996 Lovelace ..... B23Q 3/186 29/271
5,590,474 A * 1/1997 Lamb ..... B25B 27/16 29/271
5,799,408 A * 9/1998 Sprayberry ..... B25B 27/16 29/271
5,988,296 A * 11/1999 Zachman ..... E04H 17/263 173/1
6,308,934 B1 * 10/2001 Gallo ..... B25C 11/00 254/21
6,663,083 B1 * 12/2003 Smith ..... B25C 11/00 254/131
6,901,823 B2 * 6/2005 Ernesti ..... B25B 13/46 7/138
6,948,700 B2 * 9/2005 Wood ..... B66F 15/00 254/18
8,091,865 B2 * 1/2012 Eric ..... B66F 15/00 254/25
8,752,224 B2 * 6/2014 Ortiz ..... B29C 70/70 156/242
9,902,055 B1 * 2/2018 Baker ..... B25F 1/006
2002/0101017 A1 * 8/2002 Kolarik ..... B25B 27/10 269/43
2009/0094757 A1 * 4/2009 Newton ..... A62C 8/00 7/166
2012/0228568 A1 * 9/2012 Leon ..... B25F 1/006 254/21
2014/0173873 A1 * 6/2014 Butterfield, IV ..... G01B 5/25 29/407.09
2014/0325765 A1 * 11/2014 Weddle ..... A62B 3/005 7/166

* cited by examiner

SLEEVER BAR

CROSS REFERENCES TO RELATED APPLICATIONS

This non-provisional application claims priority under 35 USC 119(e) to United States provisional application U.S. 62/301,936 filed on Mar. 1, 2016 by the inventor: David Troutman of Springfield W.V.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fixed constructions, more specifically, a cantilever based tool for aligning structural steel.

A sleever bar is tool typically used by ironworkers in order to align two pieces of structural steel when erecting a structure. The sleever bar is an elongated bar made of hardened steel, which is used to provide leverage during alignment before joining a first structural steel member to a second structural steel member.

SUMMARY OF INVENTION

The improved sleever bar comprises a bar, a removable nut and a fixed nut. The fixed nut is permanently attached to the bar at a fixed position. The removable nut is attached to the bar such that the position of the removable nut is adjustable. The improved sleever bar is adapted for use with a first object. The improved sleever bar is further adapted for use with a second object. The first object further comprises a first plurality of holes. The second object further comprises a second plurality of holes. Each of the first plurality of holes is a cylindrical aperture formed through the first object. Each of the second plurality of holes is a cylindrical aperture formed through the second object.

In a first function of the improved sleever bar, the improved sleever bar aligns the first object with the second object such that the center axis of each of the first plurality of holes is aligned with the center axis of a hole selected from the second plurality of holes such that a nut and bolt selected from a plurality of nuts and bolts can be used to secure the first object to the second object. In a second function of the improved sleever bar, the improved sleever bar separates the first object from the second object.

These together with additional objects, features and advantages of the improved sleever bar will be readily apparent to those of ordinary skill in the art upon reading the following detailed description of the presently preferred, but nonetheless illustrative, embodiments when taken in conjunction with the accompanying drawings.

In this respect, before explaining the current embodiments of the improved sleever bar in detail, it is to be understood that the improved sleever bar is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved sleever bar.

It is therefore important that the claims be regarded as including such equivalent construction insofar as they do not depart from the spirit and scope of the improved sleever bar. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
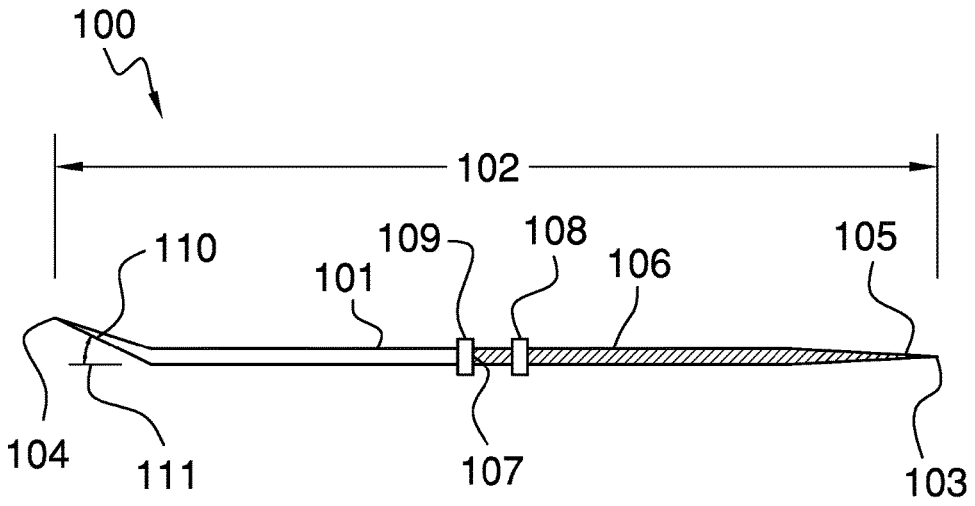
FIG. 1 is an assembled side view of an embodiment of the disclosure.
Figure 2:
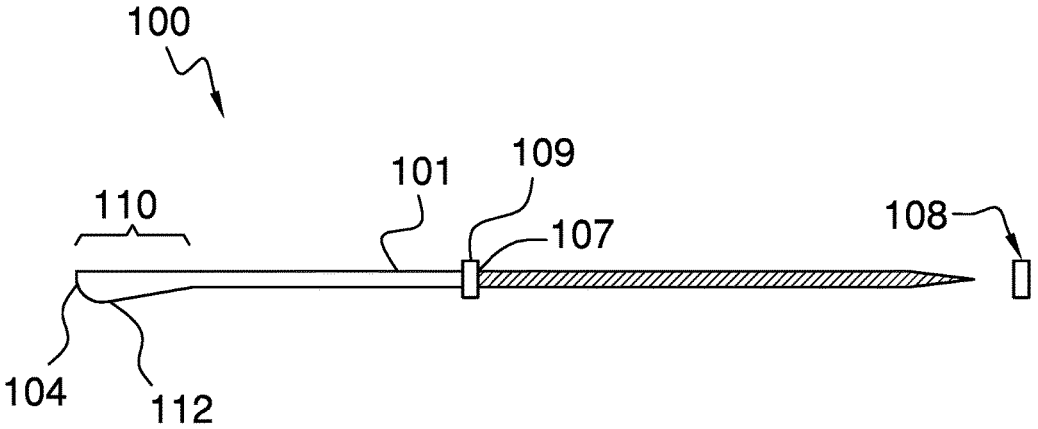
FIG. 2 is an exploded front view of an embodiment of the disclosure.
Figure 3:
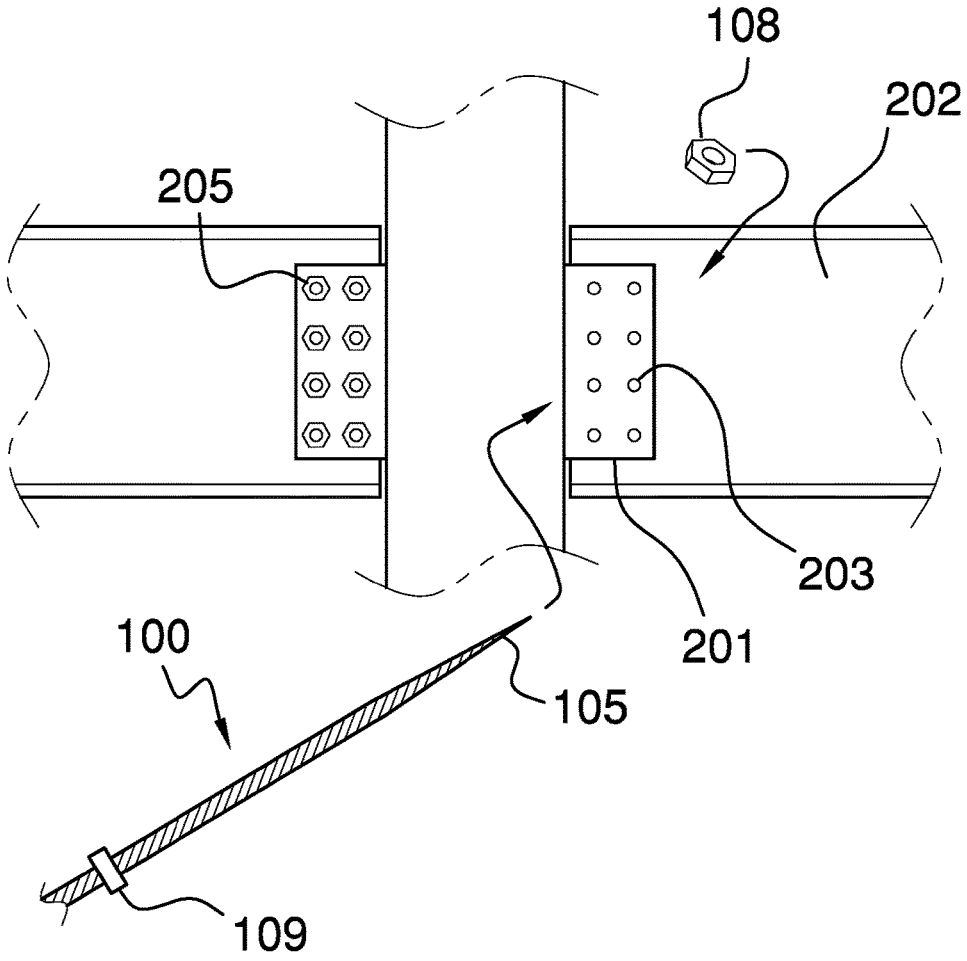
FIG. 3 is an in use view of an embodiment of the disclosure.
Figure 4:
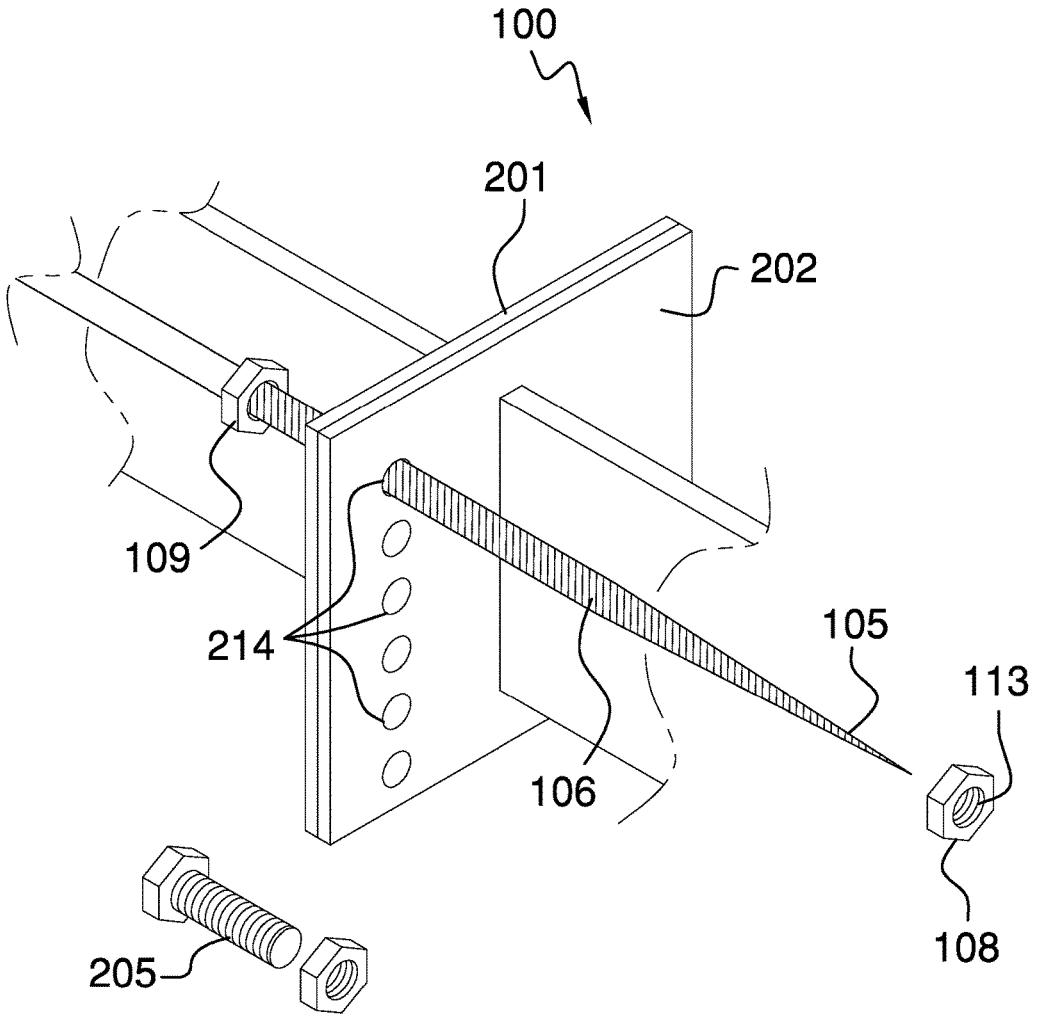
FIG. 4 is an in use view of an embodiment of the disclosure.
Figure 5:
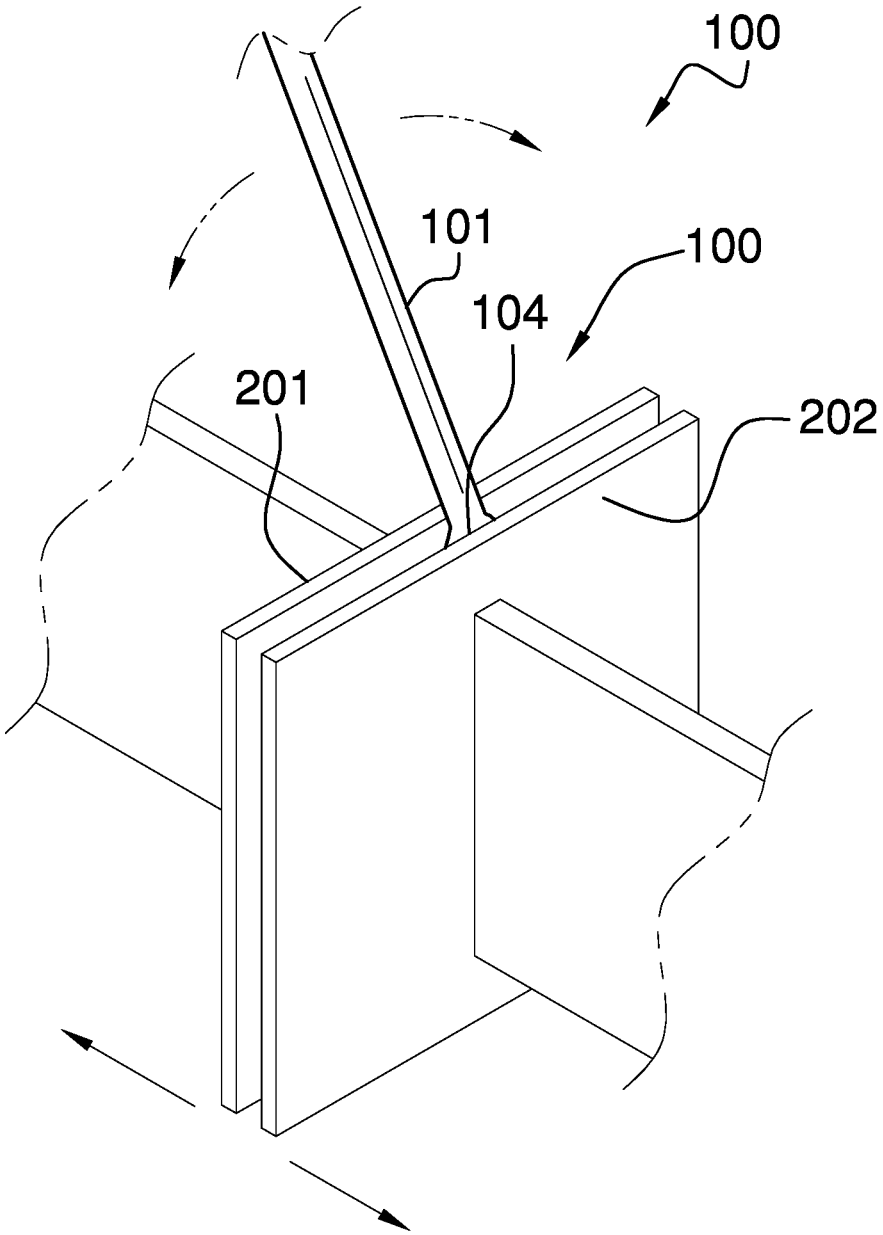
FIG. 5 is an in use view of an embodiment of the disclosure.

Detailed reference will now be made to one or more potential embodiments of the disclosure, which are illustrated in FIGS. 1 through 5.

The improved sleever bar 100 (hereinafter invention) comprises a bar 101, a removable nut 108 and a fixed nut 109. The fixed nut 109 is permanently attached to the bar 101 at a fixed position. The removable nut 108 is further defined with an interior screw thread 113. The removable nut 108 is attached to the bar 101 such that the position of the removable nut 108 is adjustable. The invention 100 is adapted for use with a first object 201. The invention 100 is further adapted for use with a second object 202. The first object 201 further comprises a first plurality of holes 203. The second object 202 further comprises a second plurality of holes 204. Each of the first plurality of holes 203 is a cylindrical aperture formed through the first object 201. Each of the second plurality of holes 204 is a cylindrical aperture formed through the second object 202. In a first function of the invention 100, the invention 100 aligns the first object 201 with the second object 202 such that the center axis of each of the first plurality of holes 203 is aligned with the center axis of a hole selected from the second plurality of holes 204 such that a nut and bolt selected from a plurality of nuts and bolts 205 can be used to secure the first object 201 to the second object 202. In a second function of the invention 100, the invention 100 separates the first object 201 from the second object 202.

It is explicitly acknowledged that the initial intended use of the disclosed invention 100 is in construction arts. Specifically, the first object 201 is initially intended to be a first structural steel member and the second object 202 is initially intended to be a second structural steel member. However, those skilled in the art will recognize that the innovations described in this disclosure can be readily modified to accommodate the substitution of the first structural steel member and the second structural steel member with alternate object sets requiring alignment with a minimum of modification and experimentation.

The bar 101 is a readily and commercially available cylindrical shaft. The bar 101 is further defined with a length 102, a first end 103, and a second end 104. The bar 101 further comprises a point 105 and an exterior screw thread 106. The bar 101 is inserted through the fixed nut 109 such that the fixed nut 109 is permanently secured to a first position 107 on the bar 101. It is assumed that the fixed nut 109 is screwed onto the bar 101 over the exterior screw thread 106 however this need not be the case. The exterior screw thread 106 is formed on the bar 101 from the first position 107 to the first end 103. The first end 103 of the bar 101 is formed with a taper such that the tip of the first end 103 forms the point 105. The purpose of the point 105 is to reduce the cross-sectional area of the bar 101 such that the point 105 of the bar 101 can be, through the use of well-known percussive methodologies, inserted through a first hole selected form the first plurality of holes 203 and the associated second hole selected from the second plurality of holes 204 in a manner that forces the alignment of the first plurality of holes 203 and the second plurality of holes 204. Methods to form exterior screw threads in metal bars are well known and documented in the mechanical arts. Methods to form tapers to a point are well known and documented in the mechanical arts.

The bar 101 further comprises an angled claw 110. The angled claw 110 is located at the second end 104 of the bar 101. The angled claw 110 further forms an angle 111 between the center axis of the bar 101 and the direction towards which the angled claw 110 projects away from the bar 101. The angle 111 formed by the angled claw 110 provides enhanced leverage when the invention 100 is used to separate the first object 201 from the second object 202. The angled claw 110 is a flattened edge 112 that allows the angled claw 110 to be more readily inserted between the first object 201 and the second object 202.

The interior screw thread 113 of the removable nut 108 is sized such that the interior screw thread 113 will screw onto the exterior screw thread 106 forming a threaded connection.

The first function of the first potential embodiment of the disclosure is to temporarily align the first plurality of holes 203 of a first object 201 to a second plurality of holes 204 of a second object 202 such that a plurality of nuts and bolts 205 may be installed through each hole selected from the first plurality of holes 203 and the associated hole selected from the second plurality of holes 204 such that the first object 201 is permanently secured to the second object 202. To do this, the point 105 is the bar 101 is inserted through a first hole selected from the first plurality of holes 203 and the associated hole selected from the second plurality of holes 204 in order to align, and to hold in alignment, the first plurality of holes 203 and the second plurality of holes 204. This alignment is temporarily held in position by adaptively adjusting the position of the removable nut 108 relative to the fixed nut 109 in manner that: 1) aligns the first plurality of holes 203 and the second plurality of holes 204; and 2) tightens the first object 201 against the second object 202. Once all but the last nut and bolt set selected from the plurality of nuts and bolts 205 are installed such that the first object 201 is permanently secured to the second object 202: 1) the removable nut 108 is removed; 2) the bar 101 is removed; and the final nut and bolt set is installed.

To use the first potential embodiment of the disclosure to perform the second function of separating the first object 201 from the second object 202, the flattened edge 112 of the angled claw 110 is inserted between the first object 201 and the second object 202. The bar 101 is then rotated using the angled claw 110 as a pivot to generate the leverage necessary to separate the first object 201 from the second object 202.

The bar 101 is formed from a material selected from the group consisting of a metal, a carbon fiber composite, or a plastic. The use of hardened steel is preferred. The remaining components are readily and commercially available The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cross-section: As used in this disclosure, a cross-section is a surface or shape that would be exposed by making a straight cut through an object.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Exterior Screw Thread: An exterior screw thread is a ridge wrapped around the outer surface of a tube in the form of a helical structure that is used to convert rotational movement into linear movement.

Interior Screw Thread: An interior screw thread is a groove that is formed around the inner surface of a tube in the form of a helical structure that is used to convert rotational movement into linear movement.

Nut: As used in this disclosure, a nut is a first object that is formed with an interior screw thread such that a second object with a matching exterior screw thread can screwed into the first object forming a threaded connection.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A tool comprising:

a lever bar, a removable nut and a fixed nut;

wherein the fixed nut is permanently attached to the lever bar at a fixed position;

wherein the removable nut is further defined with an interior screw thread;

wherein the removable nut is attached to the lever bar such that the position on the lever bar of the removable nut is adjustable;

wherein the tool is adapted for use with a first object;

wherein the tool is further adapted for use with a second object;

wherein the first object further comprises a first plurality of holes;

wherein the second object further comprises a second plurality of holes;

wherein each of the first plurality of holes is a cylindrical aperture formed through the first object;

wherein each of the second plurality of holes is a cylindrical aperture formed through the second object;

wherein the tool aligns the first object with the second object such that the center axis of each of the first plurality of holes is aligned with the center axis of a hole selected from the second plurality of holes such that a nut and bolt selected from a plurality of nuts and bolts can be used to secure the first object to the second object;

wherein the tool separates the first object from the second object;

wherein the lever bar is a cylindrical shaft;

wherein the lever bar is further defined with a length, a first end, and a second end;

wherein the lever bar further comprises a point and an exterior screw thread;

wherein the lever bar further comprises an angled claw;

wherein the angled claw is located at the second end of the lever bar;

wherein the angled claw further forms an angle between the center axis of the lever bar and the direction towards which the angled claw projects away from the lever bar;

wherein the angled claw further comprises a flattened edge;

wherein the fixed nut is permanently secured to a first position on the lever bar;

wherein the exterior screw thread extends from the fixed nut at the first position to the first end;

wherein a portion of the lever bar extending from the fixed nut at the first position to the second end is a non-threaded portion of the lever bar;

wherein the exterior screw thread is formed on the lever bar from the first position to the first end;

wherein the first end of the lever bar is formed with a taper such that the tip of the first end forms the point;

wherein the point reduces the cross-sectional area of the lever bar.

2. The tool according to claim 1 wherein the interior screw thread of the removable nut is sized such that the interior screw thread will screw onto the exterior screw thread forming a threaded connection.

3. The tool according to claim 2 wherein the lever bar is formed from a material selected from the group consisting of a metal, a carbon fiber composite, or a plastic.

4. The tool according to claim 3 wherein the lever bar is formed from a hardened steel.

5. The tool according to claim 4 wherein the first object is a first structural steel member;

wherein the second object is initially intended to be a second structural steel member.

6. The tool according to claim 1 wherein the interior screw thread of the removable nut is sized such that the interior screw thread will screw onto the exterior screw thread forming a threaded connection.

7. The tool according to claim 6 wherein the lever bar is formed from a material selected from the group consisting of a metal, a carbon fiber composite, or a plastic.

8. The tool according to claim 7 wherein the lever bar is formed from a hardened steel.

* * * * *